US005117765A

United States Patent [19]

Wahl

[11] Patent Number: 5,117,765

[45] Date of Patent: Jun. 2, 1992

[54] TRAFFIC SIGNALING DEVICE

[76] Inventor: Thomas G. Wahl, 4008 W. 73rd St., Prairie Village, Kans. 66208

[21] Appl. No.: 643,119

[22] Filed: Jan. 18, 1991

[51] Int. Cl.[5] ..... G08B 5/02; G09F 11/14

[52] U.S. Cl. ..... 116/63 P; 40/491

[58] Field of Search ..... 116/63 P, 63 R, 283, 116/306, 321; 40/589, 586, 491

[56] References Cited

U.S. PATENT DOCUMENTS

| | | | |
|---|---|---|---|
| 1,531,745 | 3/1925 | Fitch | 116/63 P |
| 1,600,067 | 9/1926 | Retze | 116/63 P |
| 3,001,185 | 9/1961 | Cleek | 116/18 |
| 3,283,429 | 11/1966 | Stutz | 40/491 |
| 3,659,367 | 5/1972 | Yumoto | 40/491 |
| 4,837,957 | 6/1989 | Egender | 40/491 |
| 4,841,674 | 6/1989 | Smith | 40/491 |

*Primary Examiner*—William A. Cuchlinski, Jr.
*Assistant Examiner*—John L. Beres
*Attorney, Agent, or Firm*—Richard P. Stitt

[57] ABSTRACT

A traffic signaling device is provided which enables a roadway work site flagman to selectably control the traffic instructions displayed to motorists traveling in opposite directions through the use of multiple louver sets which may be selectably interposed to change the message presented to motorists.

9 Claims, 2 Drawing Sheets

Fig. 1
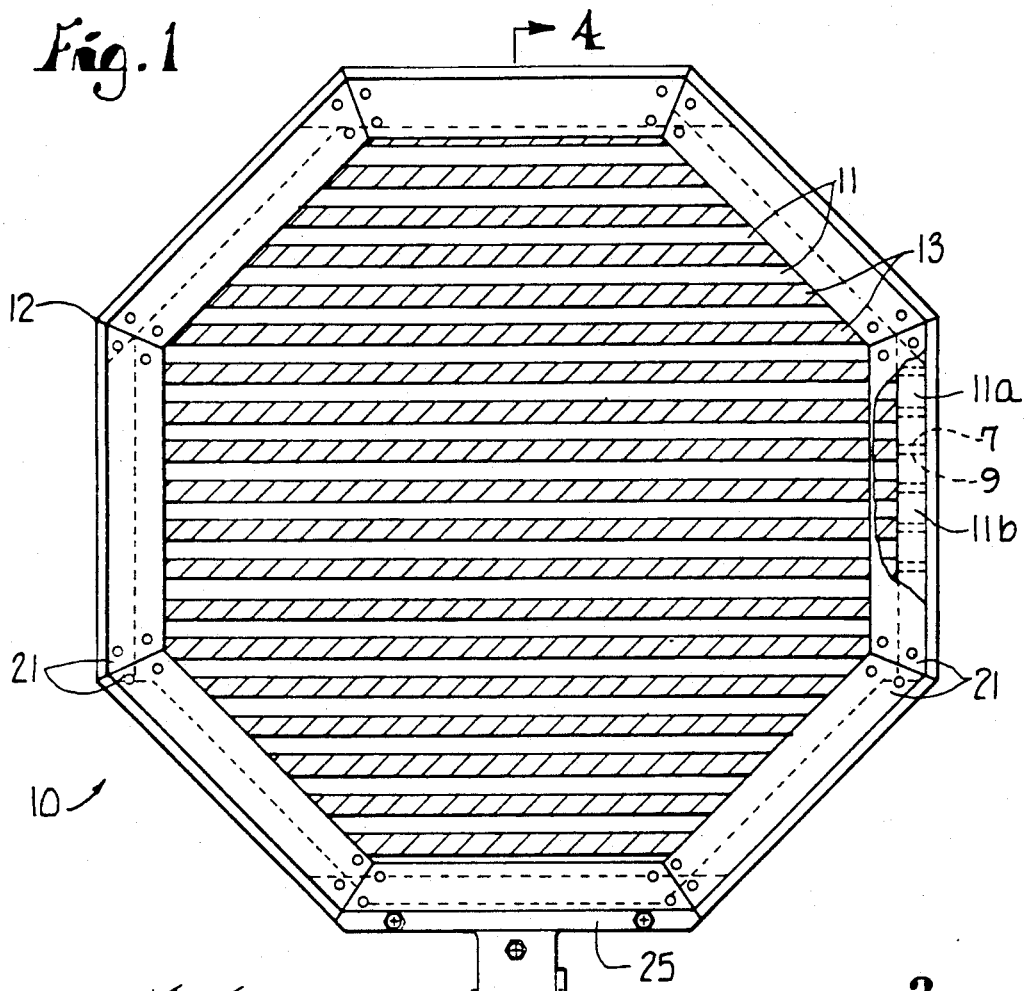
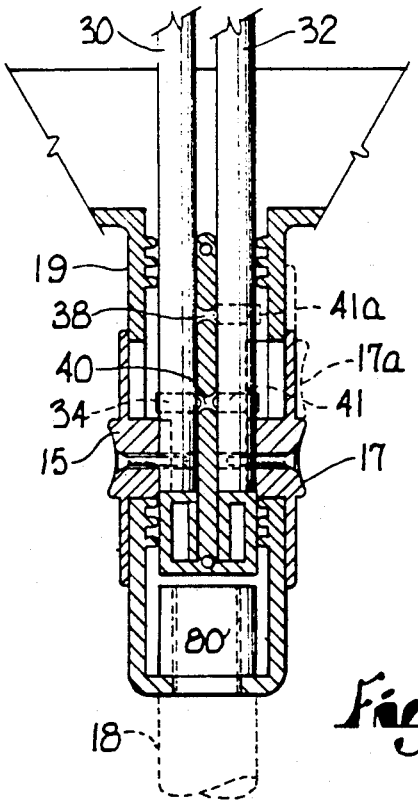
Fig. 2
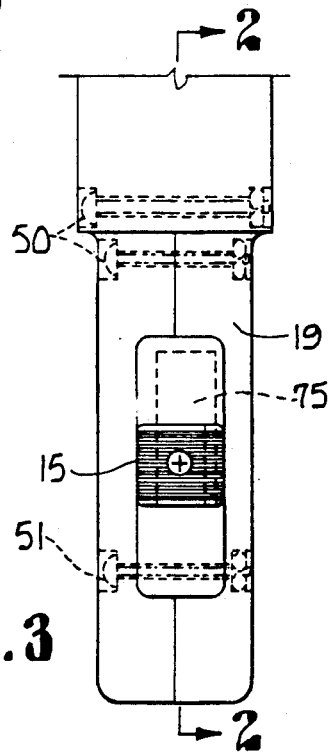
Fig. 3

TRAFFIC SIGNALING DEVICE

This invention relates to a traffic control device and more particularly to a manual STOP/SLOW signaling device utilized in controlling traffic flow through construction work zones.

BACKGROUND OF THE INVENTION

In the course of working on roadways or conducting construction proximate to roadways it is often necessary to modify traffic flow through the work zone. When workers and construction equipment are near a roadway it may be necessary to slow the traffic, or if workers or construction equipment must cross the roadway it is necessary to bring traffic to a halt.

Previously, directing traffic: flow in these situations has been achieved through the use of a flagman, positioned at the work area, holding a traffic signaling device or flag. Depending upon the construction activity and the proximity of the construction activity to the roadway it is frequently necessary for the flagman either to stop or slow the traffic approaching the construction area. This is accomplished by the flagman utilizing a handheld traffic signaling device bearing the legend SLOW on one side and the legend STOP on the opposite side. As traffic progresses toward the flagman either the STOP or the SLOW legend can be selected to direct traffic activity within the work site. However, the inherent limitations of the conventional STOP/SLOW flagging device cause a number of difficulties for both flagman and drivers.

The conventional traffic signaling device continually presents both faces to observers. When traffic in one direction is observing the SLOW legend, traffic approaching from the opposite direction necessarily is presented with the STOP legend. This can cause confusion to drivers and difficulties for the flagman when the intention is to control only one lane of traffic rather than both lanes of traffic. For example, if a flagman is standing on the side of a two lane road with traffic approaching from both directions the intent may be only to signal oncoming traffic within the lane to which he is nearest. However, traffic moving in the opposite direction will unavoidably be presented with the reverse side of the signaling device, indicating that it also should slow or stop, when the intent is to allow that traffic to move freely.

In another situation, where construction equipment must move across both lanes of traffic, it may be necessary for the flagman to stop oncoming traffic in both directions. The conventional hand signaling device does not allow for this possibility. The flagman must either use hand signals to stop traffic in both directions or two flagmen, each with a sign, must deal with each oncoming lane of traffic.

This failure of conventional signaling devices either to present proper signals to both lanes of traffic or to present no signal at all to one of the lanes of traffic results in confusion for motorists and the inability of the flagman to efficiently direct traffic. When motorists are traveling through an unfamiliar area and are not aware of the construction zone or are presented with detour signs or painted barrels barricading traffic movement a degree of confusion is inherent in the scene confronting a driver. When that driver also observes a traffic signaling device, which may or may not be directed towards him, the potential for mishaps within the construction area substantially increases.

For the flagman this presents a situation in which the flagman must continually check behind himself to determine if traffic in the opposite direction has been affected by the apparent, but unintended, traffic signal facing their direction. This diversion of the flagman's attention can lead to additional problems in controlling the traffic flow or accidents.

Another problem that arises in the use of conventional traffic signaling devices is that the reflective surfaces of the signaling devices are constantly exposed to the elements and exposed to frictional contact with surroundings during storage. This exposure of the reflective services tends to wear away at the reflective material thus impairing the observation of the device by drivers during evening or nighttime hours.

Accordingly, my apparatus presents a novel method of presenting traffic signals to motorists driving in opposing directions while presenting the flagman with greater control of the traffic and greater selectivity in the traffic signal presented to motorists.

It is therefore a general object of this invention to provide an apparatus adaptable to conventional roadway work sites which provides more specific control of traffic.

Another object of the present invention is to permit a roadway flagman to selectably determine the traffic signal to be presented on either side of traffic signaling device.

Another object of the present invention is to provide traffic signal clarification to motorists approaching a roadway work site.

Yet another object of the present invention is to prevent the display of confusing signals to motorists.

A further object of the present invention is to prevent the need for flagmen to divert their attention from oncoming traffic to motion to motorists which have improperly responded to a traffic signal unintentionally displayed in their direction.

Yet a further object of the present invention is to present a traffic signaling apparatus which will have protected reflective surfaces and thereby maintain its reflective nature for long periods of time.

The above and further objects and novel features of the invention will more fully appear from the following description when the same is read in conjunction with the accompanying drawings.

BRIEF DESCRIPTION OF THE DRAWINGS

FIG. 1 is a front elevational view of the invention and showing with cross hatching the movable louvers partially covering the fixed louvers and showing the handle extending from the lower edge of the invention;

FIG. 2 is a sectional elevation view, on an enlarged scale, taken along line 2—2 in FIG. 3;

FIG. 3 is a side elevational view, on an enlarged scale, of the handle and showing one of the switches for selectable movement of the movable louvers.

DESCRIPTION OF THE PREFERRED EMBODIMENTS

Figure 4:
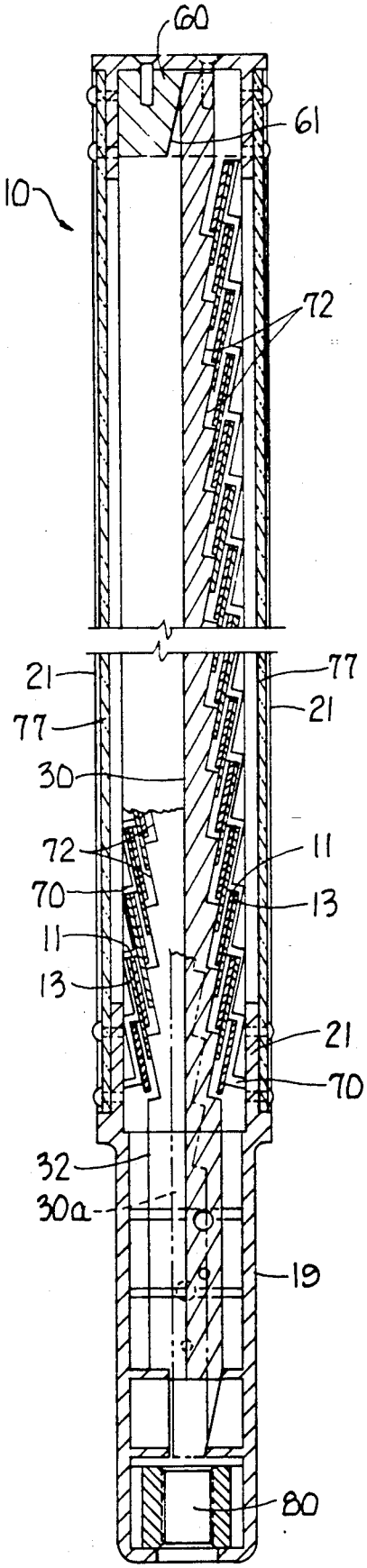
FIG. 4 is a sectional elevational view taken along line 4—4 in FIG. 1 and showing the movable louvers and the fixed louvers and the drive rods attached to the movable louvers.

Referring now to FIG. 1, wherein a front elevational view of the present invention is shown, it should be noted that the rear view of the invention is a mirror image of that shown in FIG. 1. Signaling device 10 is composed of an octagonal frame 12 composed of side members 21. Attached to bottom side member 25 is handle 19 which serves as a convenient means of supporting the signaling device 10 and also contains a switching mechanism (described in detail herein) which is utilized to change the legend appearing on signaling device 10.

Still referring to FIG. 1 fixed louvers 11 and movable louvers 13 are shown with movable louvers 13 in a half-raised position. Therefore, movable louvers 13 are partially blocking the view of fixed louvers 11. It should be understood that the illustrated half raised position of movable louvers 13 is not intended as a normal functioning position of movable louvers 13, but is included for illustrative purposes to show the juxtaposition of movable louvers 13 with respect to fixed louvers 11.

It will be understood, by one skilled in the art, that when movable louvers 13 are in their lowered position only fixed louvers 11 will be presented to an observer. When this is the case a legend or an instruction such as STOP or SLOW which is printed upon the entire face of fixed louvers 11 will be displayed to an observer. When it is desired to display a different legend movable louvers 13 are raised, by a mechanism yet to be described, and will completely cover fixed louvers 11 thus blocking the legend or traffic instruction imprinted upon fixed louvers 11. In this manner, a second traffic instruction/legend imprinted upon the face of movable louvers 13 may be displayed to an observer. While the half-raised position of movable louvers 13 shown in FIG. 1 is not an operational position, such halfway positioning of movable louvers 13 may be utilized when it is desired to blockout the traffic instruction imprinted on both fixed louvers 11 and movable louvers 13 and thereby present no traffic instruction to the observer.

The fixed louvers 11 are slightly angled forward from a true vertical position. This angling of fixed louvers 11 permits the upper edge of a louver to be positioned above and in front of the lower edge of the louver above. This relationship between adjacent fixed louvers 11 is shown in phantom lines. Fixed louver 11*a* is positioned just above fixed louver 11*b*. It may be observed that top edge 7 of fixed louver 11*b* is positioned slightly above bottom edge 9 of fixed louver 11*a*. In this manner a continuous surface is presented to an observer.

Handle 19, attached to bottom side member 25, has switch 15 and switch 17 mounted on opposite sides. Switch 15 is used to control the movable louvers 13 of one side of signaling device 10. Switch 17 is used to control the movable louvers 13 of the reverse side of signaling device 10.

Referring now to FIG. 4, a cross-sectional view of the invention taken along line 4—4 of FIG. 1, and showing the position of the fixed and movable louvers. The ends of fixed louvers 11 are attached on either side to mounting rails 70 which are attached to frame members 21. The mounting rails 70 are slightly slanted from the vertical direction to provide the previously discussed slight angle to fixed louvers 1. This slanting of the mounting rails 70, and in turn fixed louvers 11, permits the fixed louvers to be spaced apart thereby permitting the movable louvers 13 to be interposed between adjacent fixed louvers 11 when it is desired to change the legend observed on signaling device 10.

To accomplish this insertion, moveable louvers 13 are attached to drive rod 30, 32 shown in FIG. 4. Drive rod 30, 32 is provided with multiple angled faces 72. Faces 72 are at an angle from vertical corresponding to the angle at which fixed louvers 11 are mounted in side rails 70. Affixed to angled faces 72 of drive rod 30, 32 are movable louvers 13. Being mounted in this manner, movable louvers 13 are positioned at the same angle as fixed louvers 11. The positioning of drive rod 30, 32 with respect to fixed louvers 11 is such that upward movement of drive rod 30, 32 results in movable louvers 13 being inserted through the space between adjacent fixed louvers 11. Completed upward movement of drive rod 30, 32 causes movable louvers 13 to completely cover fixed louvers 11. Therefore, if it is desired to cover the legend appearing on fixed louvers 11 and replace it with the legend appearing on movable louvers 13 upward pressure is applied to drive rod 30, 32 and movable louvers 13 are shifted upwardly and are guided in front of fixed louvers 11 to cover fixed louvers 11. The movement of drive rod 30, 32 toward or away from fixed louvers 11 is assisted by top housing 60 containing guide 61 which directs the movement of drive rod 30, 32 and thus movable louvers 13 up and forward in front of fixed louvers 11. Guide 61 directs drive rod 30, 32 and movable louvers 13 attached thereto in their downward movement when downward pressure is placed upon drive rod 30, 32 resulting in drive rod position 30*a* (drive rod position 32*a* is not shown).

Still referring to FIG. 4, cover 77 is shown in position to protect the reflective material used on the legend of movable louvers 13 and fixed louvers 11.

In this manner the object of maintaining the reflective quality of the device is achieved while protecting the louver mechanism.

Referring now to FIG. 2 the switching mechanism utilized to move drive rods 30, 32 will be described. It should be noted that as there are two sets of movable louvers, one set on the front side of the preferred embodiment and a second set of movable louvers on the reverse side, two drive rods 30 and 32 are required to selectably move each set of movable louvers.

Within handle 19 of signaling device 10 are the base portions of drive rods 30 and 32. Drive rods 30 and 32 are attached to switches 15 and 17. Switches 15 and 17 may be conveniently manipulated by a flagman holding signaling device 10. As shown in FIG. 2, ball plungers 34, 41 are affixed in drive rods 30, 32. Ball plungers 34, 41 are engageable within voids 40, 38 to secure drive rods 30, 32 in one of two positions. When ball plungers 34, 41 engage within void 40 movable louvers 13 are held in the lowered position allowing fixed louvers 11, and the legend thereon, to be observed. If it is desired to cover the legend printed upon fixed louvers 11 and display the legend printed on movable louvers 13 switch 15, 17 is pressed upwardly moving switch 17 to switch position 17*a*. The upward pressure causes release of the engagement of ball plunger 34, 41 within void 40 and drive rod 30, 32 are then shifted upwardly until ball plungers 34, 41 engage within void 38. The engagement of ball plunger 34, 41 within void 38 is illustrated in phantom lines by ball plunger 41*a*.

The use of the ball plunger/void mechanism causes drive rods 30, 32 to become secured into either the up or down position. Thus the operator can easily determine without observation that the desired legend is displayed on either side of the preferred embodiment to oncoming motorists.

Still referring to FIG. 2, attached to the base of handle 19 is extension pole 18 which may be screwed into screw mount 80 contained within the base of handle 19. When the flagman is in one position for long periods of time it may be more convenient for the signaling device to be mounted upon pole 18 so the device need not be continually held by the flagman. Alternatively, it may be useful to utilized extension pole 18 to hold signaling device 10 at a height greater than that which might be achieved by simply holding device 10 in the flagman's hand.

Referring now to FIG. 3, a side view of handle 19 is shown. Switch 15 is in the down position corresponding to movable louvers 13 being lowered. In phantom lines is shown track 75 in handle 19 within which switch 15, 17 travels. Also shown are securing screws 50, 51 used to hold together the halves of handle 19.

It is to be understood that while a certain form of the invention has been illustrated and described, it is not limited thereto, except insofar as such limitations are included in the following claims and the allowable functional equivalents thereof.

Having thus described the invention, what is claimed as new and desired to be secured by Letters Patent is:

1. A traffic signaling and control device comprising:

a frame presenting a first signal face and a second signal face, said first signal face comprising:

a first louver set for placement of a first legend thereon, means on said frame for mounting the louvers of said first louver set in a fixed spaced apart array, a second louver set for placement of a second legend thereon said second louver set being moveable relative to said first louver set, a first drive rod movable in first and second directions relative to said first louver set, means on said first drive rod for attaching the louvers of said second louver set relative to the louvers of said first louver set such that a selectable user movement of said first drive rod in said first direction interposes said second louver set in front of said first louver set array to cover said first legend, or drive rod movement in said second direction withdraws said second louver set from said interposition to expose said first legend, means for directing said first drive rod movement, and a switch on said first drive rod operable by the user to provide said drive rod movement;

said second signal face comprising:

a third louver set for placement of a third legend thereon, means on said frame for mounting the louvers of said third louver set in a fixed spaced apart array, a fourth louver set for placement of a fourth legend thereon said fourth louver set being moveable relative to said third louver set, a second drive rod movable in first and second directions relative to said third louver set, said second drive rod movement being independent of said first drive rod movement, means on said second drive rod for attaching the louvers of said fourth louver set relative to the louvers of said third louver set such that a selectable user movement of said second drive rod in said first direction interposes said fourth louver set in front of said third louver set array to cover said third legend, or drive rod movement in said second direction withdraws said fourth louver set from said interposition to expose said third legend and said independent movement of said second drive rod allowing separate user selection of said second signal face legend relative to user selection of said first signal face legend, means for directing said second drive rod movement, and a switch on said second drive rod operable by the user to provide said second drive rod independent movement.

2. The device as claimed in claim 1 further comprising a handle attached to said frame member.

3. The device as claimed in claim 2 wherein said switch is operable from said handle.

4. The device as claimed in claim 2 wherein said handle is adapted to receive an extension pole.

5. The traffic device as claimed in claim 1 wherein said means for directing movement is a guide block adapted to guide said rod toward and away from said third louver set to interpose or withdraw said fourth louver set from in front of said third louver set.

6. The traffic device as claimed in claim 1, wherein said means for mounting spaces one louver from another to present an aperture therebetween said aperture adapted to receive a louver of said fourth louver set therein upon said second drive rod movement.

7. The traffic device as claimed in claim 1, wherein said second signal face is mounted opposite said first signal face.

8. The traffic device as claimed in claim 1, wherein said means for mounting is a mounting rail having spaced apart surfaces for attachment of a louver thereon.

9. The traffic device as claimed in claim 8 wherein said mounting rail surfaces are angled at greater than zero degrees and at less than ninety degrees relative to a longitudinal axis of said device.

* * * * *